US008235270B2

(12) United States Patent
Gosis et al.

(10) Patent No.: US 8,235,270 B2
(45) Date of Patent: Aug. 7, 2012

(54) FASTENING TOOL HOLDING BRACKET

(75) Inventors: Anatoly Gosis, Palatine, IL (US); Anthony Caringella, Norridge, IL (US); Yury Shkolnikov, Glenview, IL (US); Kyle T. Kestner, Schaumburg, IL (US)

(73) Assignee: Illinois Tool Works Inc., Glenview, IL (US)

( * ) Notice: Subject to any disclaimer, the term of this patent is extended or adjusted under 35 U.S.C. 154(b) by 725 days.

(21) Appl. No.: 11/974,655

(22) Filed: Oct. 15, 2007

(65) Prior Publication Data

US 2009/0095786 A1 Apr. 16, 2009

(51) Int. Cl.
*B25C 7/00* (2006.01)

(52) U.S. Cl. ..... 227/19; 227/140; 227/156

(58) Field of Classification Search ..... 227/110, 227/8, 152, 151, 19, 175.1–182.1, 142, 154, 227/30, 31, 32, 140, 156
See application file for complete search history.

(56) References Cited

U.S. PATENT DOCUMENTS

| | | | | | |
|---|---|---|---|---|---|
| 622,638 | A | * | 4/1899 | Sandbo | 227/110 |
| 1,074,800 | A | * | 10/1913 | King | 227/139 |
| 2,169,433 | A | * | 8/1939 | Roy | 227/110 |
| 2,637,030 | A | * | 5/1953 | Wickman et al. | 227/151 |
| 2,797,414 | A | * | 7/1957 | Bolster | 227/110 |
| 2,915,754 | A | * | 12/1959 | Wandel | 227/5 |
| 2,994,878 | A | * | 8/1961 | Abrahamsen | 227/134 |
| 3,018,481 | A | | 1/1962 | Brooks | 227/8 |
| 3,189,341 | A | * | 6/1965 | Maurus | 269/153 |
| 3,360,176 | A | * | 12/1967 | Gehl et al. | 227/148 |
| 3,670,941 | A | * | 6/1972 | Grinnell et al. | 227/8 |
| 3,734,376 | A | | 5/1973 | Abernathy | 227/111 |
| 3,735,908 | A | * | 5/1973 | Kinney et al. | 227/67 |
| 3,822,817 | A | | 7/1974 | Umphress | 227/110 |
| 3,880,339 | A | * | 4/1975 | Bone | 227/8 |
| 3,883,064 | A | * | 5/1975 | Hilgers | 227/120 |
| 4,196,833 | A | * | 4/1980 | Haytayan | 227/8 |
| 4,211,353 | A | | 7/1980 | Aunis | 227/156 |
| 4,327,485 | A | * | 5/1982 | Rix | 29/751 |
| 4,346,831 | A | * | 8/1982 | Haytayan | 227/8 |
| 4,665,916 | A | | 5/1987 | Green | 227/178.1 |
| 4,674,669 | A | * | 6/1987 | Kozyrski et al. | 227/147 |
| 4,684,050 | A | * | 8/1987 | Masas | 227/10 |
| 4,767,043 | A | * | 8/1988 | Canlas, Jr. | 227/8 |

(Continued)

OTHER PUBLICATIONS

Illinois Tool Works, "Paslode: Model T250A-F16; Operating Manual Parts Schematic," Mar. 2006.

(Continued)

*Primary Examiner* — Lindsay Low
(74) *Attorney, Agent, or Firm* — Greer, Burns & Crain, Ltd.; Patty Chidiac; Mark W. Croll

(57) ABSTRACT

One example of the invention is a holding bracket for attachment to a fastening tool, the fastening tool having a barrel for firing a fastener, the tool defining a major axis, the holding bracket for holding overlapping portions of two members to be fastened to one another. An example holding bracket comprises a mounting portion configured for attachment to the tool and an extension portion extending from the mounting portion. A holding arm is attached to the extension portion and spaced apart from the mounting portion in the direction of the tool major axis to define a gap between the holding arm and the mounting portion, the gap for holding the overlapping portions of the two members for insertion of a fastener ejected from the barrel.

17 Claims, 10 Drawing Sheets

U.S. PATENT DOCUMENTS

| | | | | |
|---|---|---|---|---|
| 4,773,163 | A * | 9/1988 | Wolford, Jr. | 33/479 |
| 4,821,937 | A * | 4/1989 | Rafferty | 227/8 |
| 4,951,532 | A * | 8/1990 | Nelson | 81/44 |
| 5,007,573 | A * | 4/1991 | Uuskallio | 227/139 |
| 5,201,449 | A * | 4/1993 | Miller | 227/8 |
| 5,261,587 | A * | 11/1993 | Robinson | 227/8 |
| 5,261,588 | A * | 11/1993 | Lin | 227/110 |
| 5,490,334 | A * | 2/1996 | Payne | 33/613 |
| 5,509,331 | A | 4/1996 | Nickipuck | |
| 5,509,596 | A | 4/1996 | Green et al. | |
| 5,649,661 | A * | 7/1997 | Masuno et al. | 227/8 |
| 5,685,473 | A | 11/1997 | Shkolnikov et al. | |
| 5,743,455 | A * | 4/1998 | Holliday | 227/142 |
| 5,938,099 | A | 8/1999 | Ciccarelli | 227/19 |
| 6,024,267 | A * | 2/2000 | Chen | 227/8 |
| 6,286,742 | B1 | 9/2001 | Mukoyama | 227/8 |
| 6,324,743 | B1 * | 12/2001 | Gonnet et al. | 29/453 |
| 6,393,711 | B1 * | 5/2002 | Freund | 33/626 |
| 6,454,151 | B1 | 9/2002 | Wang-Kuan | 227/8 |
| 6,557,745 | B2 | 5/2003 | Wang | 227/142 |
| 6,581,815 | B1 | 6/2003 | Ho et al. | 227/142 |
| 6,592,014 | B2 | 7/2003 | Smolinski | |
| 6,631,836 | B2 * | 10/2003 | Dickhaut | 227/148 |
| 6,705,501 | B2 | 3/2004 | Miller et al. | 227/8 |
| 6,820,789 | B2 * | 11/2004 | Lipsky et al. | 227/120 |
| 6,824,036 | B2 * | 11/2004 | Walter | 227/120 |
| 6,896,168 | B1 * | 5/2005 | Logan | 227/147 |
| 6,988,648 | B2 | 1/2006 | Taylor et al. | 227/142 |
| 7,017,790 | B1 | 3/2006 | Peng | 227/119 |
| 7,051,914 | B2 * | 5/2006 | Herelier | 227/110 |
| 7,055,728 | B2 | 6/2006 | Lin | 227/110 |
| 7,070,079 | B2 * | 7/2006 | Smolinski et al. | 227/8 |
| 7,255,256 | B2 * | 8/2007 | McGee et al. | 227/8 |
| 7,341,172 | B2 * | 3/2008 | Moore et al. | 227/8 |
| 7,513,404 | B2 * | 4/2009 | Shkolnikov et al. | 227/8 |
| 7,516,876 | B2 | 4/2009 | Ohmori | 227/119 |
| 7,565,992 | B2 * | 7/2009 | Buetow | 227/110 |
| 7,712,646 | B2 | 5/2010 | Gamble et al. | 227/29 |
| 7,721,817 | B2 * | 5/2010 | McGee et al. | 173/37 |
| 2005/0040207 | A1 | 2/2005 | Gill | 227/154 |
| 2006/0016047 | A1 | 1/2006 | Blackman et al. | 16/231 |
| 2006/0027978 | A1 | 2/2006 | Young et al. | 279/62 |
| 2006/0042425 | A1 * | 3/2006 | Lin | 81/177.9 |
| 2006/0048366 | A1 | 3/2006 | Goodhue et al. | |
| 2006/0130276 | A1 | 6/2006 | Clark | 16/299 |
| 2007/0012744 | A1 * | 1/2007 | Losada | 227/107 |
| 2007/0215668 | A1 * | 9/2007 | Tabacco et al. | 227/107 |
| 2008/0110956 | A1 * | 5/2008 | Cho et al. | 227/127 |

OTHER PUBLICATIONS

DeWalt, D51275, 15 Gauge Nailer Users Manual, 2003.

* cited by examiner

FASTENING TOOL HOLDING BRACKET

FIELD

A field of the invention is holding brackets. An additional field of the invention is fastening tools having holding brackets for holding members to be fastened together. Another field is methods for fastening articles.

BACKGROUND

Fastening tools that use combustion, compressed gas, and other driving forces to shoot fasteners from a barrel and into a work surface are known. Other fastening tools such as power drills and screwdrivers are also known. Such tools can be used, for example, to fasten two members to one another. The two members may be, for example, metal framing members such as metal studs and tracks. Metal framing (typically steel) offers advantages compared to wood when used as framing materials related to strength, cost, resistance to shrinkage and warping, resistance to insect damage, resistance to combustion, and others. Metal framing has become very popular for these and other reasons.

Typical metal framing applications often include generally U-shaped metal tracks running in the horizontal direction and attached to underlying and overhead substrates which in some cases are concrete floors and ceilings. Vertical studs then connect the upper and lower track members to provide a framing skeleton. Construction panels such as wallboard, paneling or other planar facing material are then attached to this framing structure. The vertical stud may be attached to the horizontal track using a fastener such as a screw, rivet, nail, or the like. The fastener may be inserted using a fastening tool.

SUMMARY

One example of the invention is a holding bracket for attachment to a fastening tool, the fastening tool having a barrel for firing a fastener, the tool defining a major axis, the holding bracket for holding overlapping portions of two members to be fastened to one another. An example holding bracket comprises a mounting portion configured for attachment to the tool and an extension portion extending from the mounting portion. A holding arm is attached to the extension portion and spaced apart from the mounting portion in the direction of the tool major axis to define a gap between the holding arm and the mounting portion. The gap is configured for holding the overlapping portions of the two members for insertion of a fastener ejected from the barrel.

Another example embodiment of the invention is a fastening tool for driving a fastener into overlapping portions of a stud and track. An example tool comprises a barrel for ejecting a fastener and defining a major axis. The tool further comprises a movable workpiece contact element for engaging a work surface, the tool only able to be fired when the workpiece contact element has engaged a work surface and been moved in a rearward direction parallel to the barrel major axis and into a firing position. The tool further comprises a holding bracket comprising a mounting portion attached to the workpiece contact element, an extension portion extending from the mounting portion in a direction parallel to the barrel major axis, and a holding arm connected to the extension portion. A gap is defined between the holding arm and the mounting portion and dimensioned to receive the overlapping portion of the stud and track therein.

Still another embodiment of the invention is directed to a method for fastening a vertical stud to a horizontal track using a fastening tool having a barrel that defines a barrel major axis and has a discharge end through which a fastener is discharged from the barrel, the tool further including a workpiece contact element movable into a firing position. One example method comprises the steps of positioning the fastening tool to engage overlapping portions of the stud and track in a gap of a holding bracket attached to the tool, wherein the tool barrel major axis intersects the overlapping portions of the stud and track. The holding bracket comprises a mounting portion attached to the movable workpiece contact element, an extension portion extending from the mounting portion, and a holding arm connected to the extension portion and spaced apart from the tool barrel major axis in a radial direction. A gap is defined between the holding arm and the mounting portion and is configured to receive the overlapping portions of the stud and track. The method further includes a step of moving the tool towards the overlapping portions of the stud and track to move the workpiece contact element rearwards along a direction parallel to the barrel major axis into a firing position with the overlapping portions held in the holding bracket gap. A final step includes firing the tool to discharge a fastener from the barrel and through the overlapping portions of the stud and track held in the gap to fasten them to one another.

DETAILED DESCRIPTION

Figure 1:
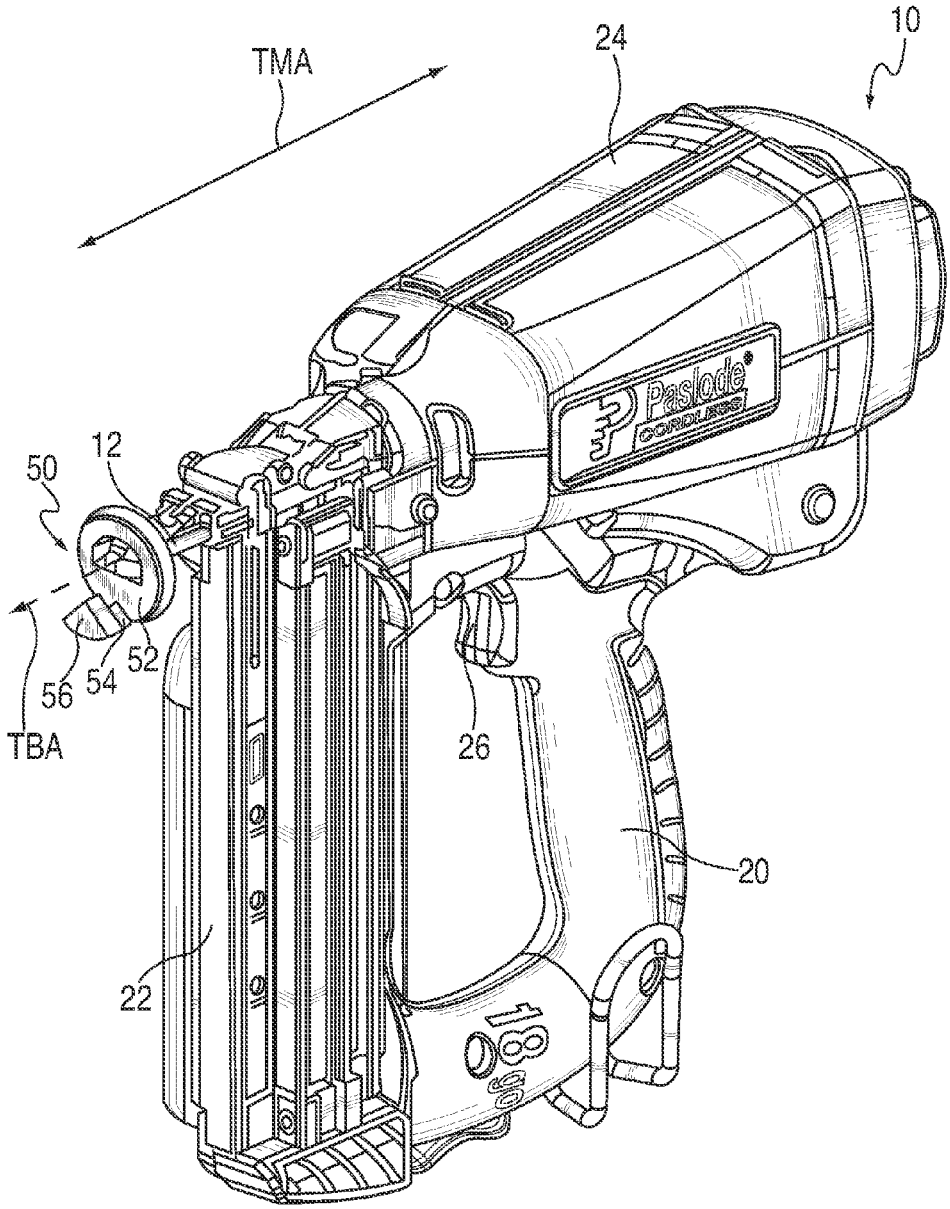
FIG. 1 is a perspective view of an example fastening tool of the invention including an example holding bracket of the invention.

Before illustrating example embodiments of the present invention in detail, it will be appreciated that the embodiments described and illustrated are examples of the invention only, and are not intended to limit the scope of the invention. It will also be appreciated that the present invention includes not only articles but methods of using articles as well. For example, one embodiment of the invention is directed to a holding bracket for use with a fastening tool. Other embodiments are directed to fastening tools that have a holding bracket and to methods for using fastening tools having a holding bracket to fasten studs to tracks. For purposes of brevity, different embodiments may be illustrated simultaneously below. For example, when discussing a holding bracket of the invention, such discussion may be considered to likewise relate to a fastening tool which includes that holding bracket and to methods for using that bracket and tool.

Turning now to the drawings, FIGS. 1-4 illustrate fastening tools and holding brackets of the invention (and are also useful to illustrate methods of using those tools and brackets to fasten horizontal tracks to vertical studs). A fastening tool shown generally at 10 is a gas powered nail gun. One example gun is a 16 gauge straight framing nail gun or an angled framing nail gun available from ITW Paslode®, Vernon Hills, Ill. Other examples include nail guns available from DeWalt Industrial Tool, Baltimore, Md., including their D51275K 15 gauge angled nailer, D51238K 18 gauge nailer, D1616K electric nailer, and others. Many other fastening tools will be suitable for practice of invention embodiments.

Many aspects of fastening tools including electric, pneumatic and combustion powered guns (with an example being the gun 10) are known in the art and are not necessary for an understanding of embodiments of the present invention. Detailed discussion of these known elements is omitted for the sake of brevity. Additional detail regarding such example elements may be obtained through reference to the following U.S. Pat. Nos. 6,592,014; 5,685,473; and 6,988,648; each of which are incorporated herein by reference.

It will be useful to illustrate aspects of the tool 10 that are useful for an understanding of embodiments of the present invention, however. The gun 10 defines a tool major axis identified as line TMA in FIGS. 1-4. The gun 10 includes a workpiece contact element ("WCE") or actuator bar 12 and a barrel 14 (FIGS. 3-4) extending in the direction of the axis TMA through which a fastener such as a nail is ejected along the tool barrel axis shown as dashed line TBA in FIG. 1 and generally parallel to the TMA.

The WCE 12 is useful to control the firing mechanism of the gun 10. A relevant portion of an example wire frame WCE is shown in isolation in FIG. 5. It includes a generally arcuate engaging end 16 for engaging a work surface that the gun 10 will fire a fastener into. The arcuate engaging end 16 defines a plane that is generally transverse to the tool major axis TMA and barrel axis TBA. The WCE 12 is movable along the direction of the tool major axis TMA so that it can travel along this direction when the tool 10 is brought closer to a work surface that the engaging end 16 has engaged. When the WCE 12 has moved a sufficient distance along the direction of the axis TMA, the gun 10 is in a firing position. The fastening tool 10 is configured so that it is prevented from firing until the WCE 12 is in this firing position. This ensures that the barrel 14 is sufficiently close to a work surface before firing of the tool 10.

The fastening tool 10 further includes a handle 20 for gripping by a user hand, and an elongate track 22 that is useful for loading fasteners (such as nails) that are held in a fastener cartridge or clip, with one example being a multiplicity of nails arranged in a strip. On the example fastening gun 10, the track 22 extends in a direction generally transverse to the axis TMA. On other example fastening guns, however, the track 22 may extend at other angles relative to the axis TMA, with one example being an orientation of about 30°. The fastening tool has a main body 24 that may house elements such as a one or more pistons, a combustion chamber, valving, a motor, gearing, electrical components, a DC power source, and other known components useful for generating and controlling firing forces. A trigger 26 is proximate to the handle and causes the fastening gun to discharge. Driving force can result from a pneumatic, combustion or mechanical event. The driving force impacts the fastener (such as a nail, rivet or the like) and causes it to be shot from the barrel 14 with sufficiently high velocity and force along the tool barrel axis TBA and into the work surface.

Figure 2:
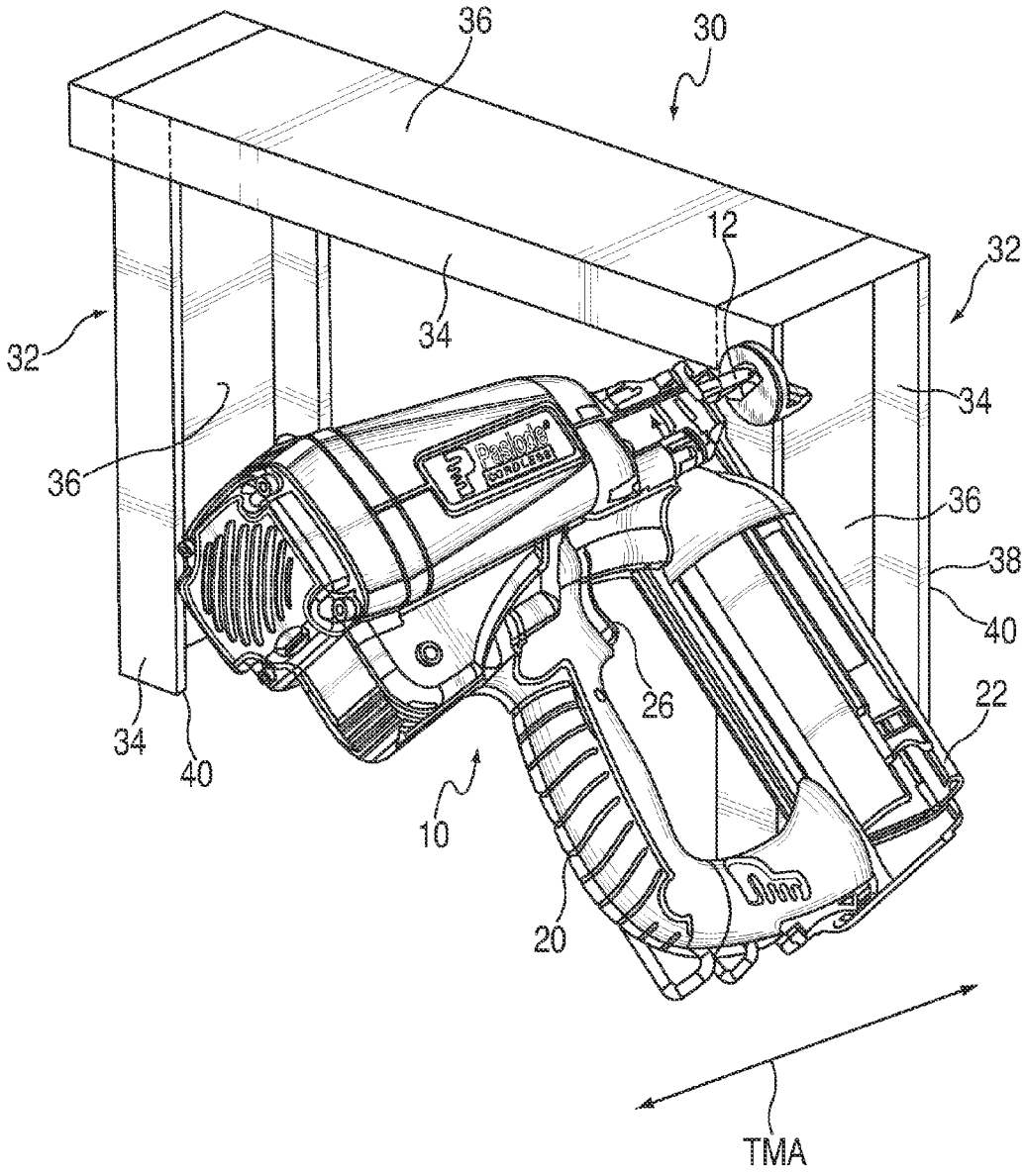
FIG. 2 shows the tool of FIG. 1 with articles held in the holding bracket.
Figure 3:
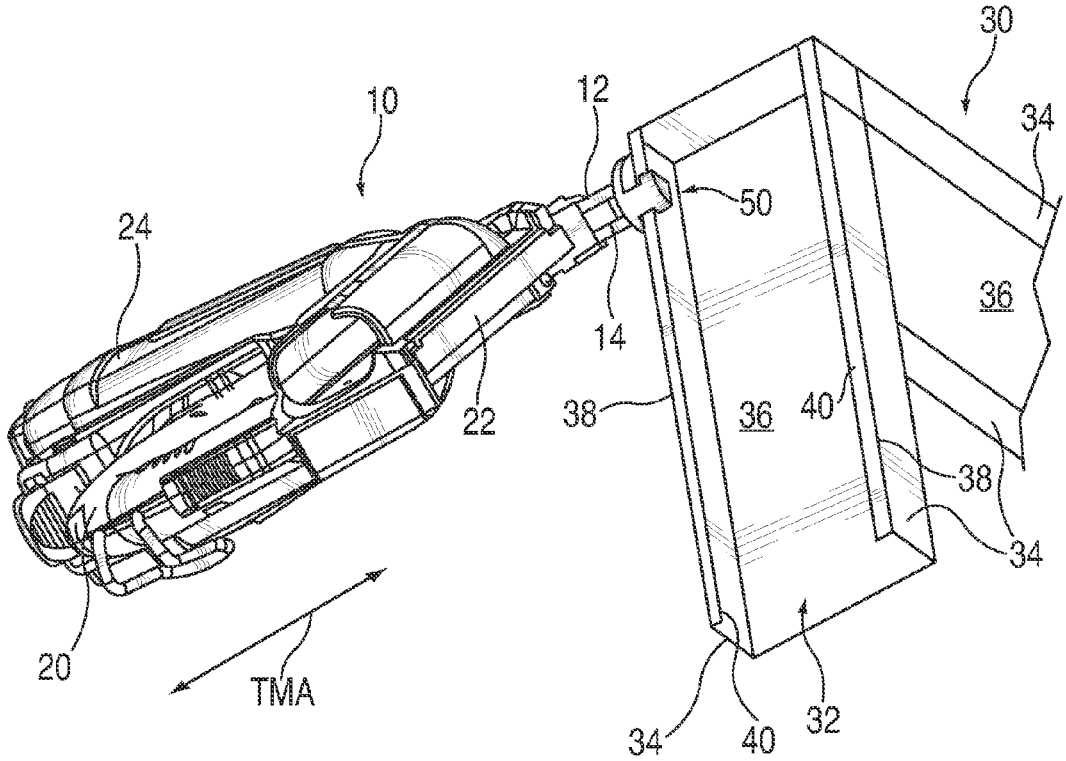
FIG. 3 shows the tool of FIG. 1 with articles held in the holding bracket.
Figure 4:
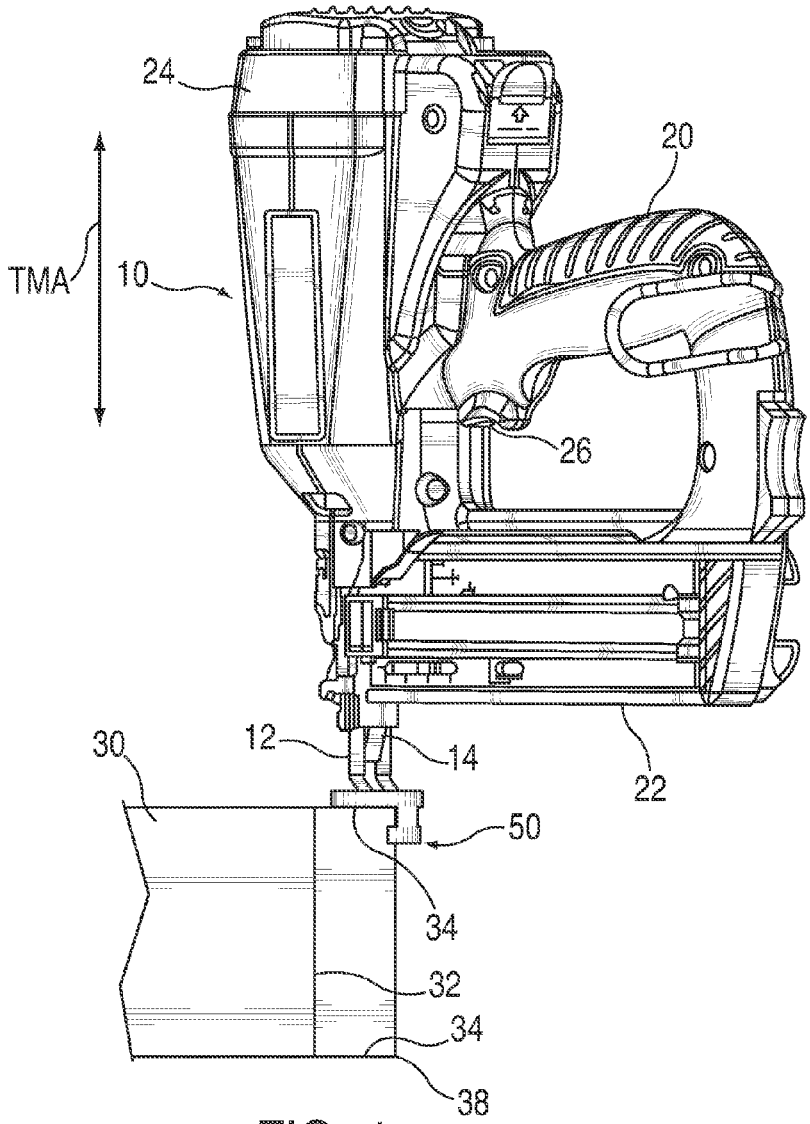
FIG. 4 shows the tool of FIG. 1 with articles held in the holding bracket.

A work surface may be, for example, one of a horizontal track 30 and vertical stud 32 best shown in FIGS. 2-4 that are desired to be fastened to one another. Tracks 30 and studs 32 are known in the art, and may be made of thin metal. Each has a generally U shaped cross section defined by two opposing sidewalls 34 that rise at an angle of 90° from a planar base 36. As illustrated in FIGS. 2-4 when tracks 30 and studs 32 are attached at right angles to one another portions of their sidewalls 34 overlap. These overlapping portions provide one useful location for inserting a fastener such as a nail, rivet, screw or the like to fasten the track 30 to the stud 32.

The sidewall of the vertical stud 34 further includes a top edge 38 with a small tab 40 (best illustrated in FIGS. 2-3) extending inward towards the opposing sidewall 34 at an angle between about 60° and 90° from the plane of the sidewall 34. The tab 40 is formed of the same metal as the sidewall 34 and base 36, and is believed to provide the sidewall 34 with additional strength.

Figure 6:
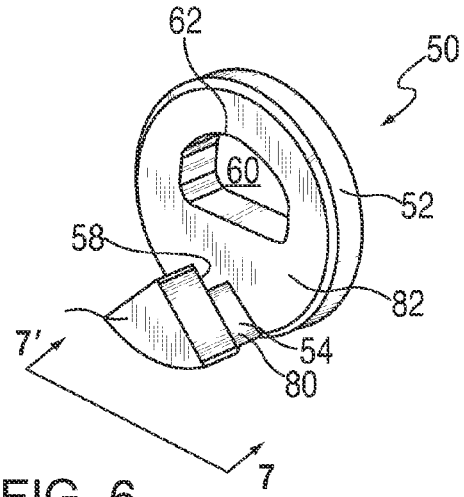
FIG. 6 is a perspective of an example holding bracket of the invention.
Figure 7:
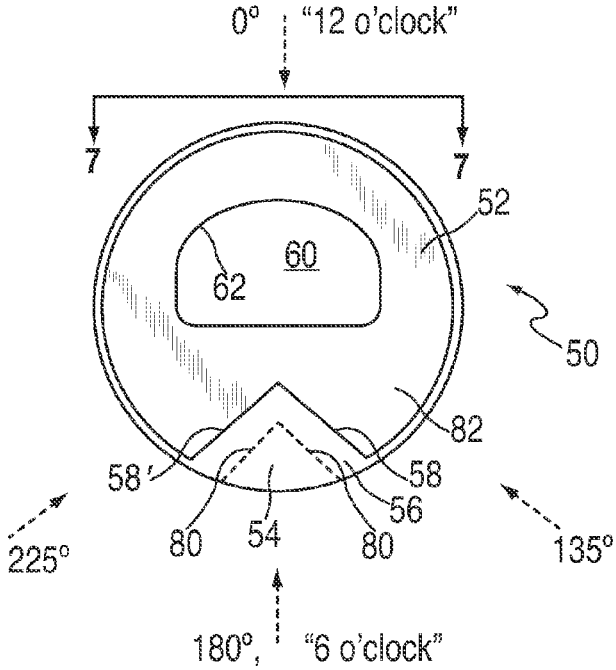
FIG. 7 is a top plan view of the holding bracket of FIG. 6 viewed from the line 7-7 of FIG. 6 and in the direction generally indicated.
Figure 8:
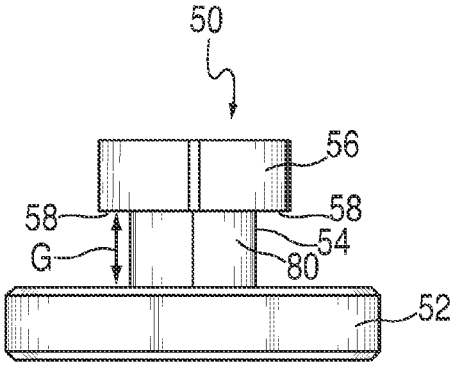
FIG. 8 is a side elevation view of the holding bracket of FIGS. 6 and 7 viewed along the line 7-7 of FIG. 7 in the direction generally indicated.

Example embodiments of the present invention further include a holding bracket shown generally at 50 in FIGS. 1-4 attached to the tool 10, and shown in greater detail in FIGS. 6-8. The bracket 50 is useful to hold articles for fastening by the tool 10, with one example being holding a portion of the track 30 and stud 32. As best shown in FIGS. 6-8, bracket 50 includes a mounting portion 52, an extension portion 54 and a holding arm 56 connected to the extension portion 54. The mounting portion 52 is generally planar, with the extension portion 54 rising at an angle of about 90° therefrom. The extension portion 54 may be attached to the mounting portion at angles other than 90°, with examples including 45°, 30°, 60°, and others. The bracket 50 may be made of any suitable material, with metals and polymers being two examples. In many applications the bracket 50 should be relatively rigid and strong. Example materials of construction include aluminum, steel, brass, alloys, and rigid polymers such as ABS and fiber reinforced polymers.

As best shown by FIGS. 6 and 7, the example holding arm 56 has a wedge or "piece of pie" shape and is coplanar with the mounting portion 52. The holding arm 56 includes a pair of shoulders 58 that face the mounting portion 52 and that at least partially define a gap identified by the line G shown in FIG. 8 between the holding arm 56 and the mounting portion 52. The gap G runs in the direction of the tool major axis TMA when the bracket 50 is installed on the tool 10. As best illustrated in FIGS. 2-4, this gap is useful to receive articles such as overlapping portions of respective sidewalls 34 of a track 30 and stud 32, with one or more of the shoulders 58 engaging one of the track 30 or stud 32 and the mounting portion 52 engaging the other. The gap G may have a width in the direction of the axis TMA as desired for a particular application. A width of between about 0.25 and about 0.30 inches has been discovered to be particularly beneficial for applications including fastening metal studs to metal tracks. Other applications may call for other gap dimensions.

Figure 5:
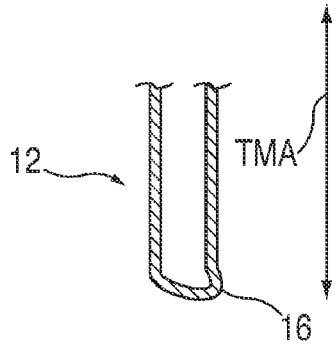
FIG. 5 shows a workpiece contact element in isolation.

As best shown in FIGS. 6-8 the holding bracket 50 further includes a passage 60 extending through the mounting portion 52 in a direction generally transverse to the plane of the mounting portion 52. The passage 60 is configured for attachment to the tool 10 through locking engagement with a portion of the tool 10. Although many different attachment configurations and elements are contemplated, the example holding bracket 50 is configured for attachment to the WCE 12 of the tool 10 (see FIGS. 1-5). The passage 60 is partially defined by an arcuate perimeter sidewall 62 shown in FIGS. 6 and 7 which is configured to engage the arcuate engagement end 16 of the WCE 12 (FIG. 5). The arcuate shape of the passage sidewall 62 is complementary to the arcuate shape of the engagement end 16 for corresponding mating.

The example holding bracket 50 can be attached via welding or soldering (if it is made of metal) to the WCE 12, with the wire frame engagement bar 16 welded to the passage 60 arcuate sidewall 62. This provides for firm and permanent attachment. Other example brackets and tools of the invention may include attachment through a compression or snap fit, particularly if the bracket is made of a material such as ABS or similar polymer. In such example applications the mounting portion passage 60 and the arcuate sidewall 62 can be sized and otherwise dimensioned to provide a compression snap fit over the engaging bar 16. To further facilitate such attachment, the perimeter of the passage 60 including the arcuate sidewall 62 can include a concave inner surface shaped to cooperate with the convex shape of the wire frame WCE 12.

Figure 9:
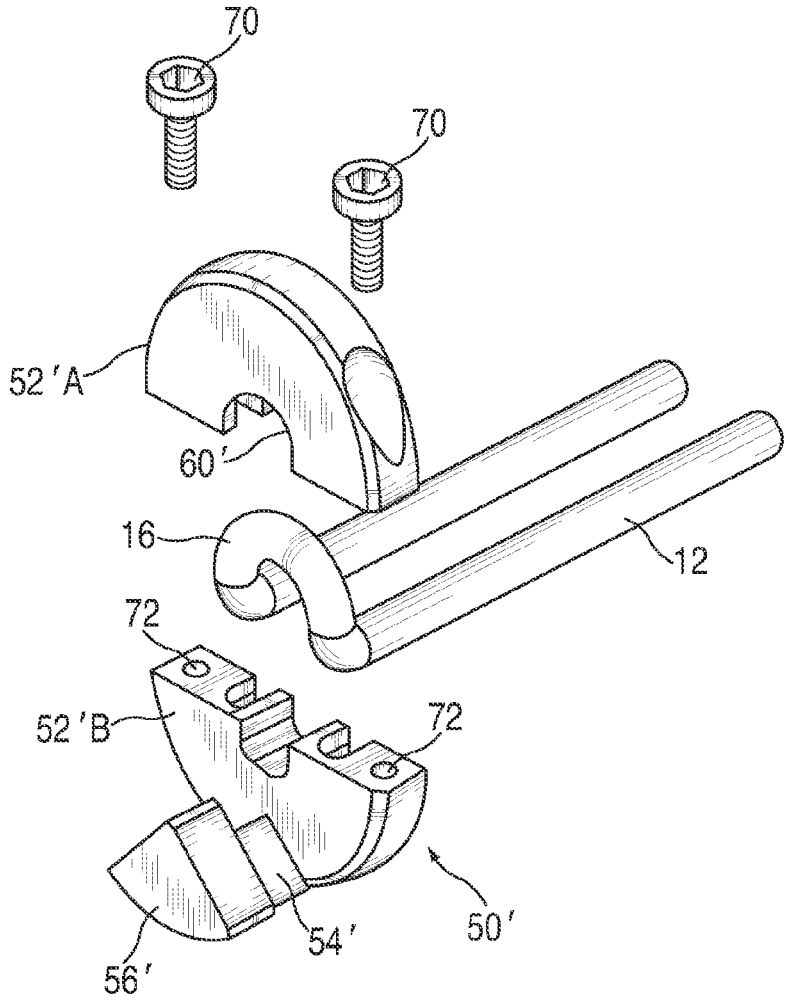
FIG. 9 is an exploded perspective view of another example holding bracket of the invention.
Figure 10:
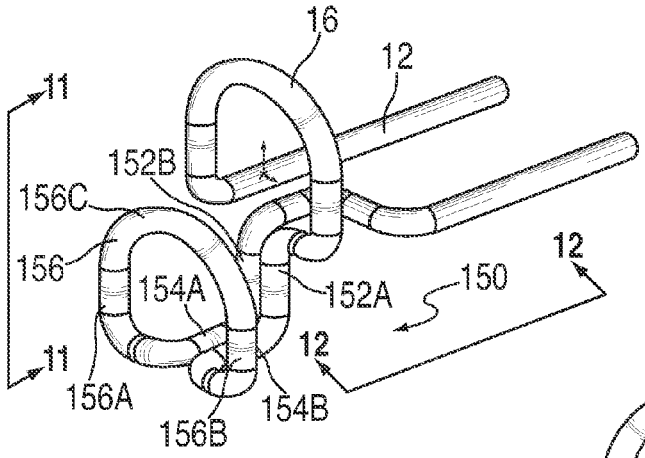
FIG. 10 is a perspective view of another example holding bracket of the invention.

Other applications may include clamping attachment of a holding bracket to a fastening tool. This can offer benefits related to ease of installation and removal from the tool. One example of a holding bracket of the invention so configured is shown in FIG. 9. Holding bracket 50' is similar in many respects to the example bracket 50 (FIGS. 1-8), with "prime" element numbers used to illustrate similar elements. The bracket 50', however, differs from the bracket 50 in at least one notable aspect. In particular, the bracket 50' is configured for clamping attachment to the WCE 12.

The mounting portion 52' of the bracket 50' is divided into two separate sections 52'A and 52'B which are lockingly engageable with one another. Each section 52'A and B have a general semicircle shape along the mounting portion 52' plane, and each partially define the passage 60'. The mounting portion 52' includes a pair of threaded passages 72 that extend through a portion of both sections 52'A and 52'B in the direction of the mounting portion 52' plane. The passages 72 are threaded to lockingly receive bolts 70 to firmly and removably lock the sections 52'A and 52'B to one another. The two sections 52'A and 52'B can be assembled to one another when the arcuate engaging bar 16 of the WCE 12 is positioned in the passage 60'. Doing so locks the bracket 50' onto the WCE 12. Other clamping mechanisms will be apparent to those knowledgeable in the art. Clamping engagement to other portions of the tool 10 are contemplated, with examples including to other portions of the WCE 12 or to the barrel 14 (FIG. 3).

Referring once again to FIGS. 1-8, because the example holding bracket 50 is attached to the WCE 12, the bracket 50 moves only with the WCE 12 and not necessarily with the gun body 24. That is, when WCE 12 is engaged against a work surface and the gun body 24 is moved towards that surface, the WCE 12 moves relative to the body in a direction along the tool major axis TMA. In other embodiments of the invention, however, a holding bracket may be attached to other portions of the tool 10 including, for instance, to the body 24.

As best shown by FIGS. 6-8, the example extension arm 54 has a general triangular shaped cross section coplanar with the plane of the mounting portion 52 and has two planar sidewalls 80 extending along the length of the gap G (FIG. 8) between the holding arm shoulders 58 and the mounting portion planar surface 82. It has been discovered that these planar extension arm sidewalls 80 in combination with the wedge shape of the holding arm 56 offer unique advantages and benefits in relation to engaging side edges of articles to be held by the holding bracket 50 such as side edges of the tracks 30 and studs 42 (FIGS. 2-4). For example, the wedge shape offers ease of engagement with articles and insertion of those articles into the gap for holding. The planar sidewalls 80 provide a useful engagement surface.

It has also been discovered that placement of the extension portion 54 and holding arm 56 in particular locations on the mounting portion 52 can likewise offer unique benefits and advantages. Referring to the holding bracket 50 as illustrated in FIGS. 1 and 7 for example, it has been discovered that placing the extension portion 54 at the "6 o'clock" position about the circular perimeter of the holding bracket 50 as oriented when the bracket 50 is installed on the tool 10 is advantageous. That is, when the tool 10 is held in an upright position by a user the tool major axis TMA is transverse to a vertical plane (and to the plane of the bracket mounting portion 52), and the uppermost portion of the tool is at the 12 o'clock position (which may also be referred to as the O position).

In this orientation, the holding bracket extension portion 54 is located lowermost (i.e., 6 o'clock or 180° position) on the bracket 50, and the passage arcuate sidewall 62 is at a 12 o'clock (or 0°) position. This positioning has been discovered to offer unique advantages and benefits in the ability to engage articles at various orientations and positions. This can be further appreciated through consideration of FIGS. 2-4 which show the gun 10 in various orientations relative to a track 30 and stud 32.

Other orientations and placements of the extension arm 54 are contemplated. For example, referencing FIGS. 1 and 7 again, and referring to the 6 o'clock position as being at 180° and the 12 o'clock being at 0° in the vertical plane when the tool 10 is in an upright position with its major axis TMA horizontal, placement of the extension arm 54 anywhere between about 135° and about 225° (shown in FIG. 7) is believed to provide suitably advantageous benefits and results. Other fastening applications may result in other placements being desirable, with specific examples including the 3 (90°), 9 (270°) or 12 o'clock (0°) positions.

When the overlapping portions of the track and stud sidewalls 34 are held in the holding bracket gap G, the holding arm shoulder 58 may engage the sidewall tab 40, with the sidewall top edge 38 engaged against the bracket extension portion flat sidewall 80. This has been discovered to be particularly beneficial since the tab 40 can exert a spring force against the shoulder 58 useful to increase the holding power of the holding bracket 50 and to thereby keep the overlapping portions of the track 30 and stud 32 held therein. It is noted, however, that as used herein the term "hold" as used when describing overlapping portions of the sidewalls 34 being held in the bracket gap G do not necessarily require that any particular portions of the overlapping sidewalls 34 be firmly engaged or even engaged at all with any particular portions of the bracket 50. Such engagement, however, may be useful in some applications and accordingly may be provided for.

The passage 60 in addition to providing a structure for attachment to a fastener tool such as the gun 10 further allows the gun to operate without interference from the bracket 50. This is best illustrated by considering the tool barrel 14 axis TBA shown in FIG. 1 that extends in the same direction as the tool major axis TMA along the length of the barrel 14. A fastener such as a nail exiting the barrel 14 will travel along the axis TBA. The bracket passage 60 is positioned so that the axis TBA is in line with it and passes therethrough. Likewise, the holding arm 56 is spaced some distance away from the axis TBA in a radial direction to the axis TBA to avoid interference with the barrel 14 and/or a fastener exiting the barrel 14.

In addition to the example holding brackets 50 and 50', many other configurations are possible within the scope of the invention. FIGS. 10-13 illustrate one such example that has been identified as holding bracket 150. The bracket 150 is of wire frame construction and is integrally attached to a wire frame WCE 12 (a tool is not shown in FIGS. 10-13, but can be consistent with the tool 10 or any similar fastening tool). It will accordingly be appreciated that the term "attached" when used herein to describe attachment of a bracket to a WCE 12 can (but does not necessarily) include integral attachment that can be achieved, for example, by forming the bracket 150 with and at the same time as the WCE 12.

The holding bracket 150 includes a mounting portion 152 formed from a pair of parallel legs 152A and 152B made of the same wire frame used to form the WCE 12. The legs 152A and 152B define a plane that is generally transverse to the tool major axis TMA (FIG. 1). The mounting portion 152 is attached to the engaging end 16 of the WCE 12. An extension portion 154 extends from the generally planar mounting portion 152 at an angle of about 90°, and is connected to a holding arm 156. The extension portion 154 is defined by two parallel legs 154A and 154B, one each integrally connected to one each of the mounting portion legs 152A and 152B.

The holding arm 156 is formed of the same metal wire frame as the mounting portion 152 and the extension portion 154, and in fact is integrally attached to each. All three may be formed from a suitable diameter metal wire which is bent into the desired configuration when at a sufficiently high temperature so as to be pliable. Or, a mold may be used. The holding arm 156 includes generally straight legs 156A and 156B integrally connected to extension portion legs 154A and 154B, and an arcuate leg 156C connecting the two legs 156A and 156B. The holding arm legs 156A, 156B and 156C collectively define a open loop or "D" shape with an open center. The holding arm arcuate leg 156C is configured to be the same size as the actuator arm arcuate engaging end 16, although other sizes are contemplated. The sizing illustrated, however, is believed to provide benefits related to holding power, ease of manufacture, and ease of use.

Figure 11:
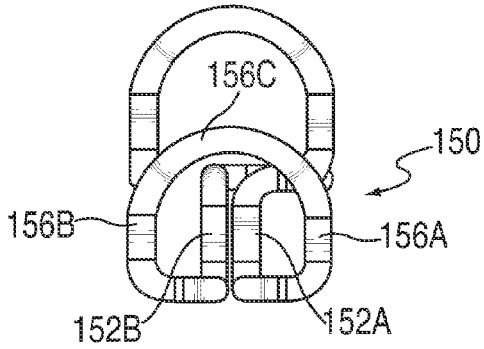
FIG. 11 is a bottom plan view of the holding bracket of FIG. 10 viewed from the line 11-11 of FIG. 10 and in the direction generally indicated.
Figure 12:
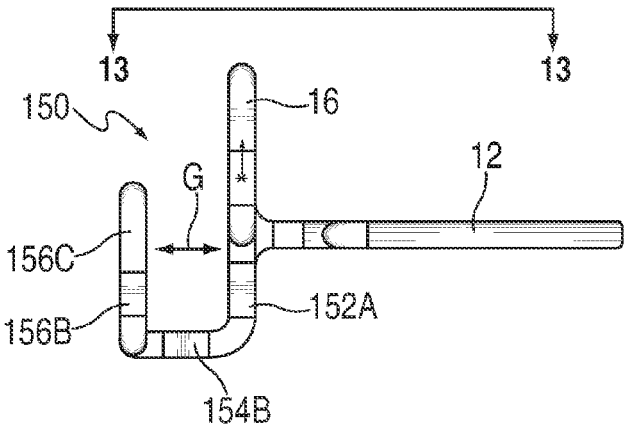
FIG. 12 is a side elevation view of the holding bracket of FIGS. 10 and 11 viewed from the line 12-12 of FIG. 10 in the direction generally indicated.
Figure 13:
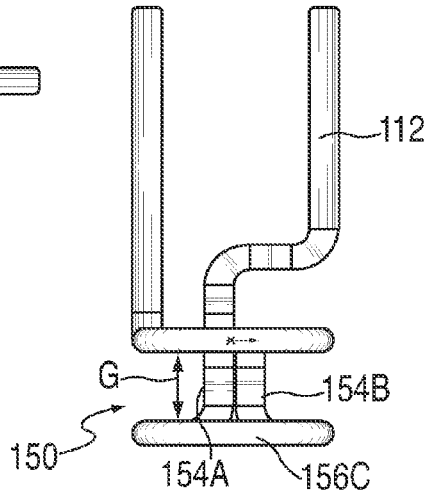
FIG. 13 is a side elevation view of the holding bracket of FIGS. 10-12 viewed from the line 13-13 of FIG. 12 in the direction generally indicated.

As best shown in the views of FIGS. 11 and 12, the holding arm 156 is offset from the WCE engaging end 116 to avoid interference with the firing of a fastener. As best shown by the views of FIGS. 12 and 13, a gap G is defined between the holding arm 156 and the mounting portion 152. The gap G is dimensioned to hold articles therein for operation on by a tool, with an example being overlapping sidewall portions of a stud 30 and track 32 (FIGS. 2-4).

Figure 14:
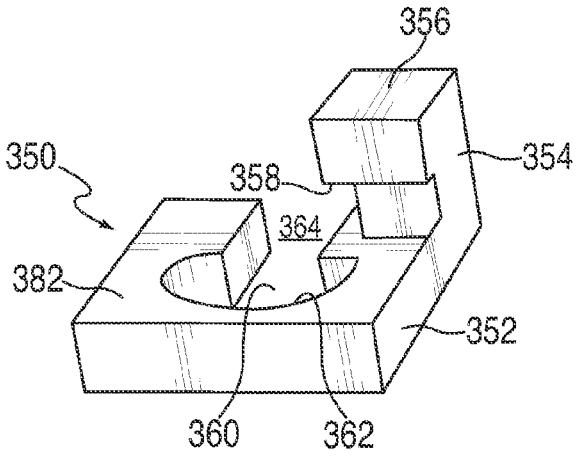
FIG. 14 is a perspective view of another example holding bracket of the invention.
Figure 15:
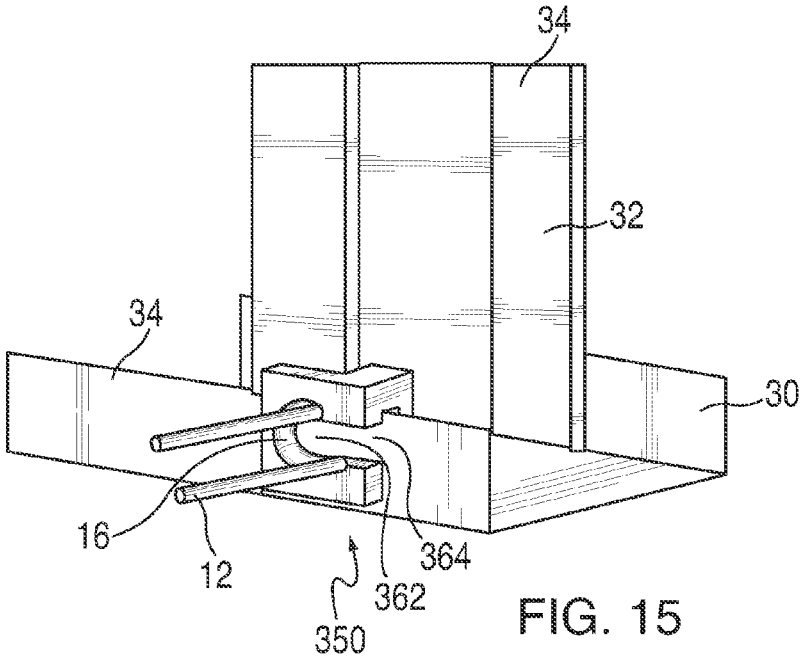
FIG. 15 is a perspective view of the example holding bracket of FIG. 14 installed on a workpiece contact element.
Figure 16:
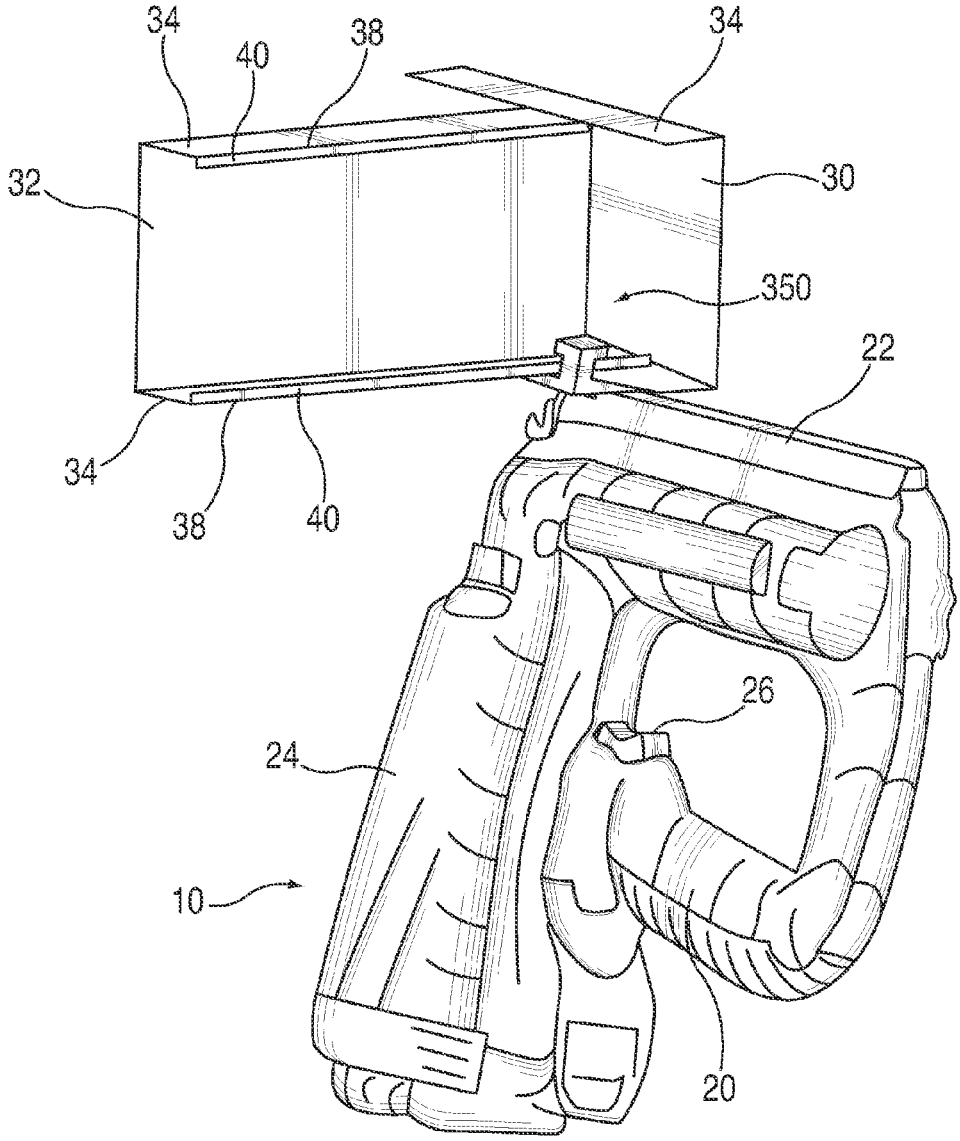
FIG. 16 is a perspective view of the example holding bracket of FIGS. 14-15 installed on an example holding tool of the invention being used to fasten a stud to a track.

FIGS. 14, 15 and 16 illustrate an additional holding bracket and fastening gun of the invention. The bracket 350 is consistent in many respects to other brackets illustrated and discussed herein including the bracket 50. For this reason, similar element numbers in the 300 series have been used for clarity. Bracket 350 includes a planar and generally square shaped mounting portion 352. Extension portion 354 rises from a corner of the mounting portion 352 at an angle of about 90 degrees and is connected to a square shape holding arm 356 which is coplanar with the mounting portion 352. The holding arm 356 has an L shaped shoulder 358 along its plane that faces a top surface 382 of the mounting portion 352. A gap is defined between the holding arm shoulder 358 and the mounting portion planar surface 382. The gap is dimensioned to hold articles to be fastened therein with an example including a track 30 and stud 32.

The mounting portion 352 further includes a passage 360 with an arcuate sidewall 362. An entrance slot 364 in the mounting portion 352 extends from the passage 360 to the outer perimeter of the mounting portion 352 with the result that the passage 360 is open on one side. As best illustrated by FIG. 16, the entrance slot 364 is configured to receive a portion of the tool 10. In particular, it is configured to receive the tool track 22 which carries a cartridge of fasteners loaded for firing by the tool 10. FIG. 15 shows, in detail, the holding bracket 350 attached to the WCE 12 (portions of the tool 10 other than the WCE 12 have been omitted from FIG. 15 for clarity of illustration) and holding overlapping portions of a track 30 and stud 32.

As shown, the WCE arcuate engaging end 16 is matingly received in the passage 360 adjacent to the arcuate sidewall 362. The holding bracket 350 may be welded onto the WCE 12, compression fit, attached using a clamping engagement (similar to that shown for bracket 50' above in FIG. 9), or fit using other means as may be desired. Although not illustrated in FIG. 15, the passage 362 is positioned so that the tool barrel axis TBA (FIG. 1) extends therethrough to avoid interference with the firing of a fastener by the tool 10. Holding arm 356 is spaced apart from the axis TBA for similar reasons.

Figure 17:
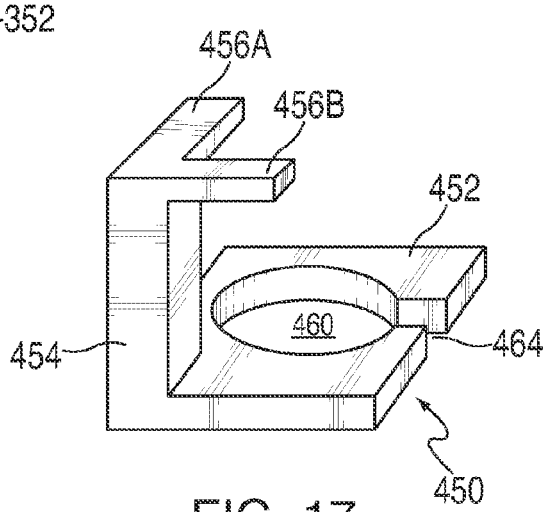
FIG. 17 is a perspective view of another example holding bracket of the invention; and, FIG. 18 is a flowchart illustrating an example method for fastening a track to a stud of the invention.

FIG. 17 illustrates yet another example holding clamp 450 of the invention. The clamp 450 includes many elements that are generally consistent with other clamps illustrated herein with like element numbers used in the 400 series for clarity. Some elements are different, however, with example being the holding arm 456 which is configured as a pair of arms 456A and 456B in a general L shape and lying along a plane that is coplanar with that of the planar mounting portion 452. Also, the passage 460 has been configured in a generally circular shape with entrance slot 464 provided to accommodate a tool track such as the track 22 (FIG. 16).

Figure 18:
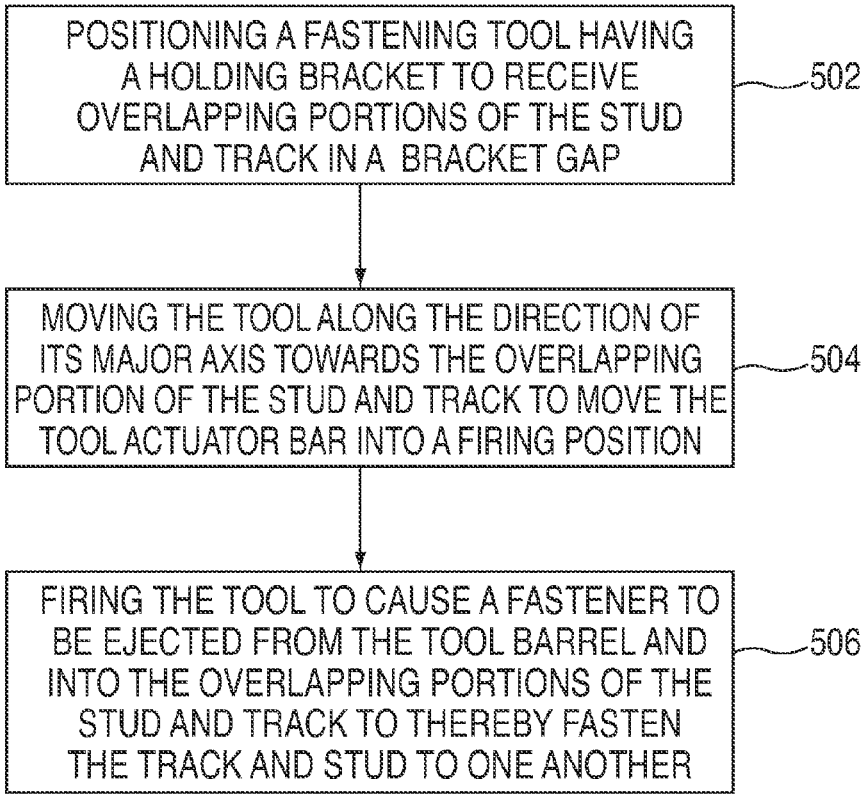

In addition to holding brackets and fastening tools having holding brackets, other embodiments of the invention include methods for attaching a vertical stud to a horizontal track. These methods include steps of using a fastening tool having a holding bracket (such as the bracket 50, 50', 150, 350 or 450) to hold overlapping sidewall 34 portions of a vertical stud 32 and horizontal track 30. FIG. 18 is a flowchart illustrating example steps of one method of the invention. Consideration the above discussion together with the flowchart of FIG. 18 will be useful to best illustrate a method of the invention.

In an initial step, a fastening tool having a holding bracket is positioned to receive overlapping portions of a vertical stud and horizontal track in a bracket holding gap. Block 502. The holding bracket may be, for example, any of the brackets 50, 50', 250, 350 or 450 that have been discussed above. Other brackets of the invention may also be used.

In a subsequent step the tool is moved in a direction generally parallel to its major axis towards an overlapping portion of the sidewalls of a stud and track when the tool WCE is engaged on one of the sidewalls. Block 504. This causes the tool WCE to move into a firing position. This step may be further illustrated by consideration of any of the FIG. 2-4, or 16. This step may include orienting the tool at a desired angle relative to the track or stud sidewall for fastening. The step may further include rotating the tool relative to the plane of the track or stud sidewall to formally engage the overlapping portions of the stud and track within the holding bracket. The degree of rotation will depend on the application, the holding bracket being used, and like factors. Rotation of from between 20°-90° are examples that will prove useful, as well as any of the tool 10 positions illustrated in FIG. 2, 3, 4 or 16.

The step of rotation may be useful to insert the overlapping portions of the stud and track into a holding bracket gap and to further engage the overlapping portions between a holding arm (such as arm 56—FIGS. 6-8) and a mounting portion (such as portion 52—FIGS. 6-8). This step may further include engaging the top edge 40 of the sidewall 34 (FIGS. 2-4, 16) on a bracket extension portion sidewall (see, for example, FIG. 2-4 or 16). In a final step, the tool is fired to cause a fastener to be ejected from the tool barrel and into the overlapping portions of the stud and track to thereby fasten the track and stud to one another. Block 506.

It will be appreciated that the example holding brackets, tools having holding brackets, and methods for using such tools and brackets for attaching studs to tracks illustrated and described herein above are examples of the invention only and the present invention is not limited to the structures or steps shown. Many alterations, equivalents and variations are possible within the scope of the invention. It will be appreciated, for example, that the invention is not limited to applications including vertical studs and horizontal tracks only. For example, a stud may be attached to a track at almost any desired angle. Further, the present invention is not limited to fastening tools such as the tool 10. Other examples of fastening tools that the invention may find utility with include other nail guns, cordless screw drivers, electric and cordless drills and the like, as well as other tools. For tools that may apply a torque to a fastener such as a threaded screw, some variations of a holding bracket may be useful to prevent rotation of the articles as a rotational force is applied to them.

Holding brackets, fastener tools and method for fastening track studs of the invention with examples illustrated herein above are useful to achieve valuable advantages and benefits over the prior art. For example, various embodiments of the present invention allow for one handed tool operation by providing a holding bracket which may be useful to hold two articles such as a track and stud to one another. Such operations may have previously required the use of two hands and/or additional tools. Further, it is submitted that various embodiments of the present invention achieve unexpected results. It was unexpected, for example, that the combination of a mounting portion, holding arm and extension arm as configured in any of the example holding brackets would provide the necessary holding power in combination with useful insertion angles to achieve one handed use of a fastening tool.

What is claimed is:

1. A holding bracket for attachment to a fastening tool, the fastening tool having a barrel for firing a fastener, the tool defining a major axis, the holding bracket for holding overlapping portions of two members to be fastened to one another, the holding bracket comprising:

a mounting portion configured for attachment to the tool;

an extension portion extending from and non-pivotally attached to said mounting portion; and a holding arm attached to said extension portion and spaced apart from said mounting portion in the direction of the tool major axis such that said mounting portion and said holding arm are parallel and define a gap between said holding arm and said mounting portion, said holding arm having two angled sides and a generally triangular-shaped cross-section formed by said two angled sides, said gap configured for holding the overlapping portions of the two members for insertion of a fastener ejected from the barrel.

2. The holding bracket as defined by claim 1 wherein the tool further includes a movable workpiece contact element, the fastener prevented from being ejected from the tool until the workpiece contact element has been moved into a firing position, and wherein said mounting portion is configured for attachment to the tool workpiece contact element.

3. The holding bracket as defined by claim 1 wherein said mounting portion is generally planar and includes a passage for receiving a portion of the fastening tool, and wherein said extension portion extends from said mounting portion at an angle of about 90°.

4. The holding bracket as defined by claim 1 wherein said mounting portion is planar and includes a passage configured to lockingly engage the tool therein, and wherein said holding arm defines at least one shoulder facing said mounting portion and at least partially defining said gap.

5. The holding bracket as defined by claim 1 wherein said mounting portion is generally planar and is configured to be attached to the tool through one or more of welded attachment or removable locking engagement, wherein said extension portion extends at an angle of about 90° from said generally planar mounting portion.

6. The holding bracket as defined by claim 1 wherein said mounting portion includes a perimeter edge, wherein said extension portion is connected to said mounting portion proximate to said perimeter edge, wherein each of said mounting portion and said holding arm define a plane and are co-planar with one another, and wherein said holding arm defines at least one shoulder for engaging an article to be held in said gap.

7. The holding bracket as defined by claim 1 wherein said gap is between about 0.25" and about 0.30" in the direction of said tool major axis, and wherein said mounting portion includes an arcuate surface corresponding to an arcuate portion of a fastening tool workpiece contact element for attachment thereto.

8. The holding bracket as defined by claim 1 wherein said mounting portion defines a first plane, wherein said holding arm defines a second plane coplanar to said first plane, and wherein said holding arm has a general wedge shape along said second plane.

9. The holding bracket as defined by claim 1 wherein the tool further includes a workpiece contact element, wherein said holding arm is generally wedge shaped and defines at least two locking shoulders facing said mounting portion, and wherein said mounting portion includes a passage for engaging a portion of the tool workpiece contact element.

10. The holding bracket as defined by claim 1 wherein the tool defines a major axis and is rotatable 360° about said major axis in a vertical plane when said tool major axis is transverse to said vertical plane with 0° located at an uppermost 12 o'clock position, wherein said extension portion is located between about 120° and about 225° in said vertical plane when the holding bracket is installed on the tool.

11. The holding bracket as defined by claim 1 wherein said mounting portion defines a plane, wherein said extension portion rises from said plane in a direction parallel to the tool major axis, and wherein said extension portion has a generally triangle shaped cross section co-planar with said mounting portion plane to define at least two flat sidewalls transverse to said mounting portion plane.

12. The holding bracket as defined by claim 1 wherein the tool includes a workpiece contact element, wherein said mounting portion includes at least two separable sections and fastening screws for locking said at least two separable sections to one another, and wherein said mounting portion is attached to the tool by locking said at least two separable sections to one another with the workpiece contact element held therebetween.

13. A fastening tool for driving a fastener into overlapping portions of a stud and track, the tool comprising:

a barrel for ejecting a fastener, the barrel defining a major axis;

a movable workpiece contact element for engaging a work surface, the tool only able to be fired when said workpiece contact element has engaged a work surface and been moved in a rearward direction parallel to said barrel major axis into a firing position; and, a holding bracket comprising:

a mounting portion attached to said workpiece contact element;

an extension portion extending from and non-pivotally attached to said mounting portion in a direction parallel to said barrel major axis;

a holding arm connected to said extension portion, said holding arm having two angled sides and a generally triangular-shaped cross-section formed by said two angled sides said mounting portion and said holding arm being parallel; and, a gap defined between said holding arm and said mounting portion and dimensioned to receive the overlapping portion of the stud and track therein.

14. The fastening tool as defined by claim 13 wherein said workpiece contact element includes an engaging end having an arcuate shape along a plane that is generally transverse to said major axis, said arcuate shape passing about a portion of the circumference of said barrel major axis, wherein said holding bracket mounting portion includes an arcuate surface connected to said arcuate shaped engaging end, and wherein said holding arm is spaced apart from said barrel major axis in a radial direction wherein said holding arm does not interfere with firing of said fastener along said barrel major axis.

15. The fastening tool as defined by claim 13 wherein when the tool is held in a natural position, an uppermost portion is at the 12 o'clock or 0° position in a vertical plane transverse to said barrel major axis, and wherein said extension portion is located between about 120° and about 225° in said vertical plane and spaced apart from said barrel major axis in a radial direction.

16. The fastening tool as defined by claim 13 wherein said holding bracket mounting portion is generally planar along a plane transverse to said barrel major axis, wherein said extension portion extends from said mounting portion at an angle of about 90° from said plane, wherein said holding arm is coplanar with said plane, and wherein said holding arm defines a plurality of shoulders facing said mounting portion.

17. A holding bracket for attachment to a fastening tool, the fastening tool having a barrel for firing a fastener, the tool defining a major axis, the holding bracket for holding overlapping portions of two members to be fastened to one another, the holding bracket comprising:

a mounting portion configured for attachment to the tool;

an extension portion extending from and non-pivotally attached to said mounting portion; and a holding arm attached to said extension portion, said holding arm being spaced apart from said mounting portion in the direction of the tool major axis such that said mounting portion and said holding arm are parallel and define a gap between said holding arm and said mounting portion, said gap configured for holding the overlapping portions of the two members for insertion of a fastener ejected from the barrel, said mounting portion defining a plane and including a passage transverse to said plane, wherein the barrel defines a barrel major axis in line with said passage and generally transverse to said mounting portion plane, and wherein said holding arm is spaced apart from the barrel major axis in a radial direction when said mounting portion is attached to the tool wherein said holding arm will not interfere with the firing of a fastener from the tool barrel.

* * * * *